United States Patent [19]

Itoh et al.

[11] Patent Number: 4,817,877

[45] Date of Patent: Apr. 4, 1989

[54] SHREDDING MACHINE

[75] Inventors: Tetsuya Itoh, Nara; Shougo Iwai, Yamatokoriyama; Shizuo Yoshikawa, Kitakatsuragi, all of Japan

[73] Assignee: Sharp Kabushiki Kaisha, Osaka, Japan

[21] Appl. No.: 164,338

[22] Filed: Mar. 4, 1988

[30] Foreign Application Priority Data

Mar. 4, 1987 [JP] Japan ..... 62-50871
Mar. 9, 1987 [JP] Japan ..... 62-53733

[51] Int. Cl.[4] ..... B02C 18/22

[52] U.S. Cl. ..... 241/34; 241/225; 241/236; 271/111

[58] Field of Search ..... 241/34, 236, 35, 235, 241/36, 222, 223, 224, 225; 83/500–503, 436; 271/9, 35, 165, 110, 111, 114, 38, 258, 259

[56] References Cited

U.S. PATENT DOCUMENTS 4,192,467 3/1980 Hatanaka ..... 241/34
4,444,382 4/1984 Ishikawa et al. ..... 271/111 X
4,466,604 8/1984 Kishimoto et al. ..... 271/111

FOREIGN PATENT DOCUMENTS 2214800 9/1973 Fed. Rep. of Germany ..... 241/236
41133 2/1987 Japan ..... 271/110

*Primary Examiner*—Mark Rosenbaum
*Attorney, Agent, or Firm*—Birch, Stewart, Kolasch & Birch

[57] ABSTRACT

A shredding machine includes a pair of juxtaposed cutting rollers for shredding paper material, a movable paper feed tray for supporting the paper material to be shredded on it, a paper feed tray drive motor capable of moving the paper feed tray between lowered and elevated positions, a paper feed mechanism and a control circuit for controlling the shredding operation. The paper feed mechanism comprises paper feed rollers for feeding the paper material from the paper feed tray towards the cutting rollers, a paper feed roller drive motor for driving the paper feed rollers and an actuator for detecting the position of the uppermost paper of a stack of papers placed on the paper feed tray. The operation of the paper feed mechanism is interrupted in the case where the actuator is not activated by the stack of papers over a predetermined period of time. Abnormal conditions of the drive motors can be detected by the control circuit on the basis of an electric voltage being supplied to each motor.

3 Claims, 12 Drawing Sheets

SHREDDING MACHINE

BACKGROUND OF THE INVENTION

1. Field of the Invention

The present invention generally relates to a cutting machine for cutting paper into pieces such as documents to be discarded or disposed and, more particularly, to a shredding machine or shredder.

2. Description of the Background Art

A shredder provided with a paper feed mechanism for feeding papers to be cut into pieces is well known and disclosed in, for example, the German Pat. No. 2,214,799 first published on Sept. 27, 1973.

According to the German patent, the paper feed mechanism provided in the shredder comprises a paper tray supported by a machine side wall for movement up and down between lowered and elevated positions, an elastic member such as a spring for urging the paper tray to the elevated position at all times, and a motor-driven paper feed roller positioned immediately above the paper tray in the elevated position. This paper feed mechanism is so designed that, assuming that a batch of papers to be shredded is placed on the paper tray and urged up against the paper feed roller through the paper tray by the action of the spring with the uppermost paper held in contact with the paper feed roller, one or a number of the papers can be fed towards a rotary cutter assembly comprised of a pair of juxtaposed cutting rollers for shredding and discharged into a container after the shredding.

Since according to the German patent the paper tray is normally urged towards the paper feed rollers, the placement of a batch of papers to be shredded on the paper tray requires an operator of the shredder to push the paper tray down towards the lowered position, rendering the machine to require a complicated handling procedure.

Accordingly, the shredding operation is occasionally initiated in a state in which the papers are improperly set on the paper tray. Because of this, some trouble is liable to take place on the papers being fed towards the cutting rollers.

In order to solve this problem, a particular construction has been proposed in which the paper tray is moved by an electric motor. In this construction, however, the motor is subjected to overload when a foreign substance or substances have accidentally obstructed or interrupted the movement of the paper tray. This occasionally causes a breakdown of the shredder and produces some problem during the operation thereof.

SUMMARY OF THE INVENTION

Accordingly, the present invention has been developed with a view to substantially eliminating the above discussed problem inherent in the prior art shredder and has for its essential object to provide an improved shredder of a type wherein the shredding operation is immediately interrupted, when a certain paper feed trouble has been detected, so that a breakdown of the shredder may be prevented.

Another important object of the present invention is to provide a shredder of the above described type which is capable of detecting abnormal conditions of each driving means provided in the shredder to rapidly detect a cause of the breakdown of the shredder, with the control for detecting such abnormal conditions being simplified.

In accomplishing these and other objects, according to one preferred embodiment of the present invention, there is provided a shredder including a cutting means for shredding paper material, a movable paper feed tray for supporting thereon the paper material to be shredded, a feed means for feeding the paper material from the paper feed tray towards the cutting means, a paper material detecting means for detecting a topmost portion of the paper material placed on the paper feed tray, a paper feed tray driving means for moving the paper feed tray in response to a signal outputted from the paper material detecting means, and a control means for interrupting the operation of the feed means in the case where the signal outputted from the paper material detecting means remains unchanged over a predetermined length of time.

In another aspect of the present invention, the shredder includes a cutting means for shredding paper material, a movable paper feed tray for supporting thereon the paper material to be shredded, a feed means for feeding the paper material from the paper feed tray towards the cutting means, a first driving means for moving the paper material placed on the paper feed tray towards the feed means, a second driving means for driving the feed means, a comparing means for comparing an electric voltage supplied to the first and second driving means with a predetermined voltage, and a control means for controlling at least one of the first and second driving means in response to a signal outputted from the comparing means.

BRIEF DESCRIPTION OF THE DRAWINGS

These and other objects and features of the present invention will become clear from the following description taken in conjunction with a preferred embodiment thereof with reference to the accompanying drawings, in which.

DETAILED DESCRIPTION OF THE PREFERRED EMBODIMENT

Figure 1:
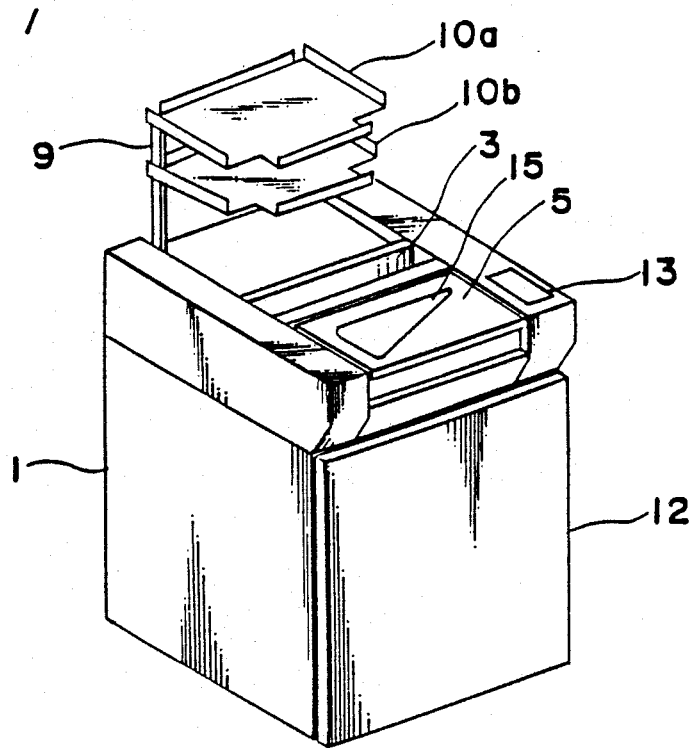
FIG. 1 is a schematic perspective view of a shredder according to a preferred embodiment of the present invention.

Before the description of the present invention proceeds, it is to be noted that like parts are designated by like reference numerals throughout the several views of the accompanying drawings.

Figure 2:
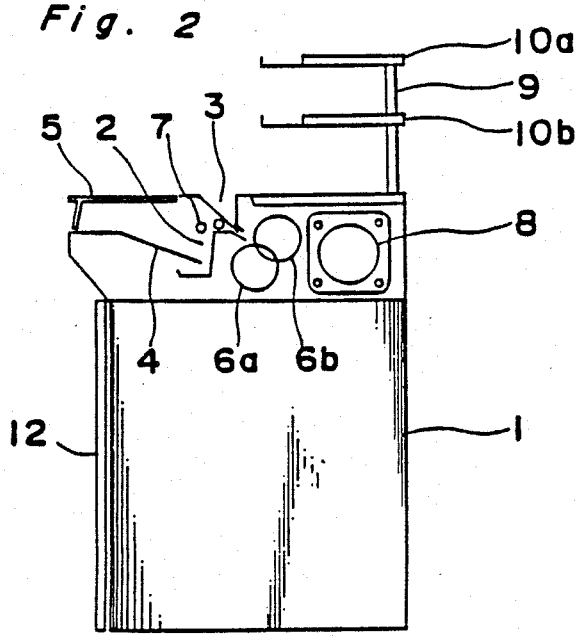
FIG. 2 is a schematic side sectional view of the shredder.

Referring first to FIGS. 1 and 2, a shredder generally identified by 1 comprises a generally rectangular box-like housing having a plurality of, for example, first and second, feed mouths 2 and 3 defined at the top thereof. The first feed mouth 2 comprises a paper feed tray 4 for the support thereon of a batch of papers to be shredded and a protective cover 5 for selectively closing and opening a paper chamber immediately above the paper feed tray 4. The protective cover 5 has a transparent windowpane 15 through which the batch of papers placed on the paper feed tray 4 can be viewed even when the protective cover 5 is in a closed position closing the space immediately above the paper feed tray 4. In this first feed mouth 2, there is disposed a paper feed roller assembly, which may be a rubber-lined roll or a plurality of rollers 7 mounted rigidly on a common carrier shaft 25 (FIG. 4) for rotation together therewith, for feeding one or a number of papers on the paper feed tray 4 towards a pair of juxtaposed cutting rollers 6*a* and 6*b* of any known construction. One or both of the cutting rollers 6*a* and 6*b* forming a cutting means are drivingly coupled with an electric drive motor 8 in any known manner.

The second feed mouth 3 is used to receive one to three papers to be shredded which are manually inserted. The paper or papers entering the second feed mouth 3 can be drawn by and fed through the cutting rollers 6*a* and 6*b*.

In the description that follows, a paper feed system extending between the first feed mouth 2 to the cutting means and including the feed roller assembly is hereinafter referred to as a batch feed system, and a paper feed system extending between the second feed mouth 3 to the cutting means is hereinafter referred to as a single feed system.

In the machine, such as in the illustrated instance, wherein the batch and single feed systems are employed, the single feed system may be utilized to receive the papers which are required to be shredded immediately while the papers fed through the batch feed system are being shredded. In such case, the supply of the papers through the batch feed system need not be interrupted, and the papers fed through the single feed system can join with the papers fed through the batch feed system as they pass through a cutting zone defined by the cutting rollers 6*a* and 6*b*.

The machine housing includes paper stands 10*a* and 10*b* positioned one above the other and mounted on the machine housing by means of a pair of support pillars 9. Each of these paper stands 10*a* and 10*b* is used to support a respective folded stack of perforated, continuous-form paper which, when each sheet of the perforated, continuous-form paper is desired to be shredded, hangs from the associated paper stands 10*a* or 10*b* downwardly into the cutting zone through the second feed mouth 3.

The machine housing also includes a hingedly supported front door 12 for selectively opening and closing an access opening leading to a container (not shown) positioned inside the machine housing and immediately below the cutting means for receiving shredded pieces of paper. The container may be a basket having a removable nylon bag installed therein or a disposable box.

Figure 3:
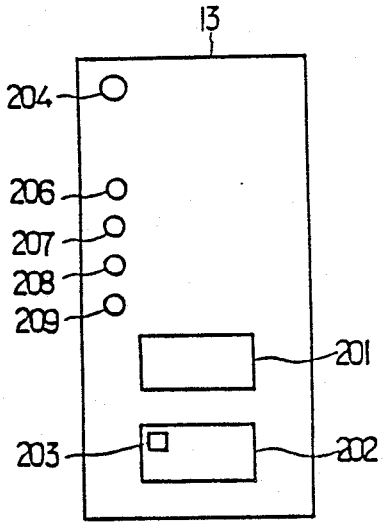
FIG. 3 is a top plan view, on an enlarged scale, of an operation panel mounted in the shredder of FIG. 1.

FIG. 3 illustrates an operation panel 13 disposed at any convenient location readily accessible to the operator, for example, at the top of the machine housing and laterally offset from the first and second feed mouths 2 and 3. The operation panel 13 is provided with a reverse key 201 for reversing the rotation of the cutting rollers 6*a* and 6*b*, a pause key 202 for interrupting and then resuming the shredding operation, a source lamp 204 and various lamps 206, 207, 208, 209 and 203. The source lamp 204 is energized when electric power is supplied to the shredder 1. The lamp 206 flickers when the aforementioned cutter drive motor 8 or other motor 16 or 21 is subjected to overload. The lamp 207 flickers when the temperature of the cutter drive motor 8 has exceeded the predetermined temperature. The lamp 208 is turned on when the container located inside the machine housing has become full of pieces of paper shredded by the cutting rollers 6*a* and 6*b*. The lamp 209 flickers when certain trouble has occurred with respect to the paper being supplied. The lamp 203 flickers during the interruption of the shredding operation.

Figure 4:
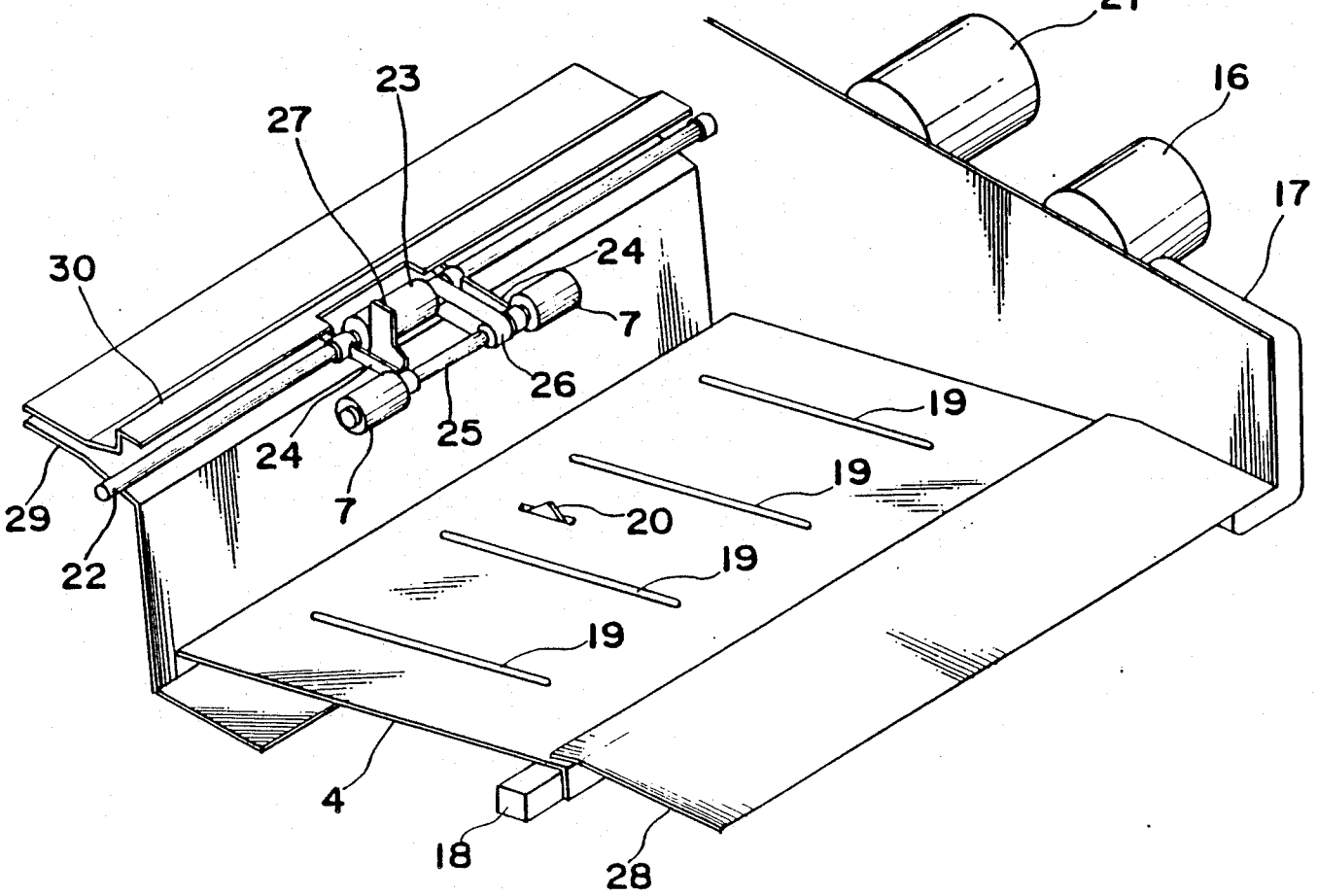
FIG. 4 is a fragmentary perspective view, on an enlarged scale, of a paper feed mechanism used in the shredder.

The details of the batch feed system extending between the first feed mouth 2 to the cutting zone and including the feed roller assembly are best illustrated in FIG. 4.

Referring now to FIG. 4, a first direct current drive motor 16 is carried by the machine housing, the drive of which is transmitted through a reduction gear unit 17 to a pivot shaft 18 to which a rear end of the paper feed tray 4, as viewed in the direction of supply of the papers to be shredded, is firmly secured. Thus, it will readily be seen that, during the operation of the first drive motor 16, the paper feed tray 4 can be moved between lowered and elevated positions, pivoting about and together with the pivot shaft 18. The paper feed tray 4 has a plurality of elongated indentations 19, for example, ribs or recesses, for the purpose of reinforcing the paper feed tray 4 thereby to minimize any possible deformation thereof, and also an actuator 20 exposed therethrough from below for detecting the presence or absence of the batch of papers or at least one paper on the paper feed tray 4.

Positioned next to the first drive motor 16 is a second direct current drive motor 21 drivingly coupled through a reduction gear unit (not shown) to a shaft 22. The shaft 22 has a conveyor roller 23 rigidly mounted thereon for rotation together therewith and also has a pair of arms 24 mounted thereon for pivotal movement about the shaft 22 independently of the rotation of the shaft 22. The paper feed roller assembly referred to above as constituted by the paper feed rollers 7 is supported by the pair of arms 24 with the common carrier shaft 25 mounted rotatably on free ends of the arms 24 remote from the carrier shaft 25.

The shaft 22 and the carrier shaft 25 are drivingly coupled with each other by means of an endless belt 26 trained therebetween so that, during the operation of the second drive motor 21 to drive the shaft 22 in one direction, the carrier shaft 25 and, hence, the paper feed rollers 27 can be driven in a direction conforming to the direction of rotation of the shaft 22.

The paper feed mechanism illustrated in FIG. 4 includes an actuator 27 for detecting the position of the uppermost paper of the batch placed on the paper feed tray 4, and some paper guide means such as a guide slide 28 continued to the rear end of the paper feed tray 4 and lower and upper guide plates 29 and 30 which are positioned one above the other so as to define a guide slot therebetween for the passage therethrough of a number of papers to be shredded from the paper tray 4.

Further details of the paper feed mechanism including the details of the paper feed systems and the details of the cutting means will be described with particular reference to FIGS. 5 to 7.

A cutter support structure 31 supports the cutting rollers 6*a* and 6*b*, and duct defining wall members 32 and 33 spaced apart from each other so as to define a duct through which shredded pieces of papers can fall downwardly into the container. The cutter support structure 31 is mounted through a plurality of rubber vibration insulators 34 on a lower housing unit 35 of the machine housing. This lower housing unit 35 is of a generally box-like configuration including the hingedly supported front door 12 for selectively opening and closing an access opening leading to the container (not shown) positioned inside such lower unit 35, said lower housing unit 35 having a top wall in which an opening 37 is defined in communication with the duct defined by the wall members 32 and 33. As previously described, the container may be a basket having a removable nylon bag installed therein or a disposable box.

The shafts 18 and 22, the guide slide 28, the protective cover 5 and the guide plates 29 and 30, all forming components of the batch feed system, are supported by a feeder support structure 36. This feeder support structure 36 is mounted directly on the lower housing unit 35 of the machine housing and positioned next to the cutter support structure 31 with respect to the direction perpendicular to the axis of rotation of each of the cutting rollers 6*a* and 6*b*.

As described above, since the feeder support structure 36 and the cutter support structure 31 are not directly connected with each other, the vibration of the cutting rollers 6*a* and 6*b* hardly affects the feeder support structure 36, thus resulting in less trouble in the paper feed mechanism.

Figure 5:
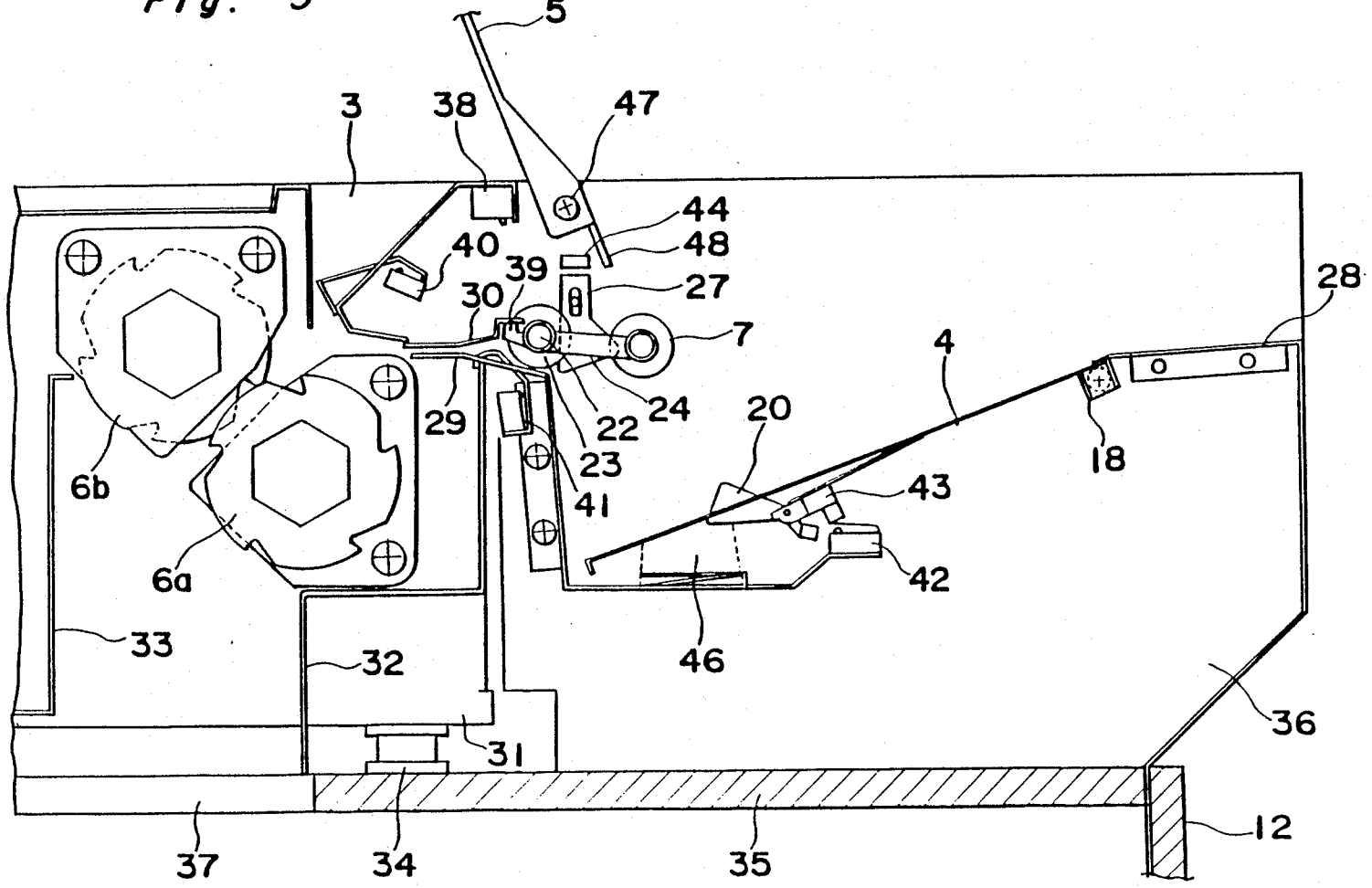
FIGS. 5 to 7 are fragmentary side sectional views of the paper feed mechanism shown in FIG. 4, illustrating the paper feed trays at different operative positions.

FIG. 5 illustrates the machine with the protective cover 5 held in the opened position. As the protective cover 5 is moved from the closed position towards the opened position, a cover sensor switch (CSW) 38 is switched off to cause the paper feed tray 4 to move from the elevated position towards the lowered position about the pivot shaft 18. During the movement of the paper feed tray 4 towards the lowered position, since the paper feed rollers 7 pivots clockwise, as viewed in FIG. 5, about the shaft 22, a projection 39 connected to, or otherwise integrally formed with one of the arms 24 so as to project in a direction remote from the paper feed rollers 7 is brought into engagement with a front edge of the upper guide plate 30 confronting the conveyor roller 23 on the shaft 22 and no further clockwise pivotal movement of the paper feed rollers 7 about the shaft 22 takes place as shown.

The machine includes electric sensor switches 40, 41, 42, 43 and 44. The sensor switch 40 is so positioned and so operable as to detect the insertion of the paper to be shredded into the paper feed mouth 3. The sensor switch 41 is so positioned and so operable as to detect the presence or absence of the papers in a duct defined between the lower and upper guide plates 29 and 30. The sensor switch 42 is so positioned and so operable as to detect the arrival of the paper feed tray 4 at the lowered position as shown in FIG. 5. The sensor switch 43 is so positioned and so operable as to detect the presence or absence of the stack of papers on the paper feed tray 4 and is operatively coupled with the actuator 20 partially exposed upwardly through the paper feed tray 4 from below. The sensor switch 44 operatively coupled with an actuator 27 is so positioned and so operable as to detect the position of the uppermost sheet of the stack of papers.

Figure 6:
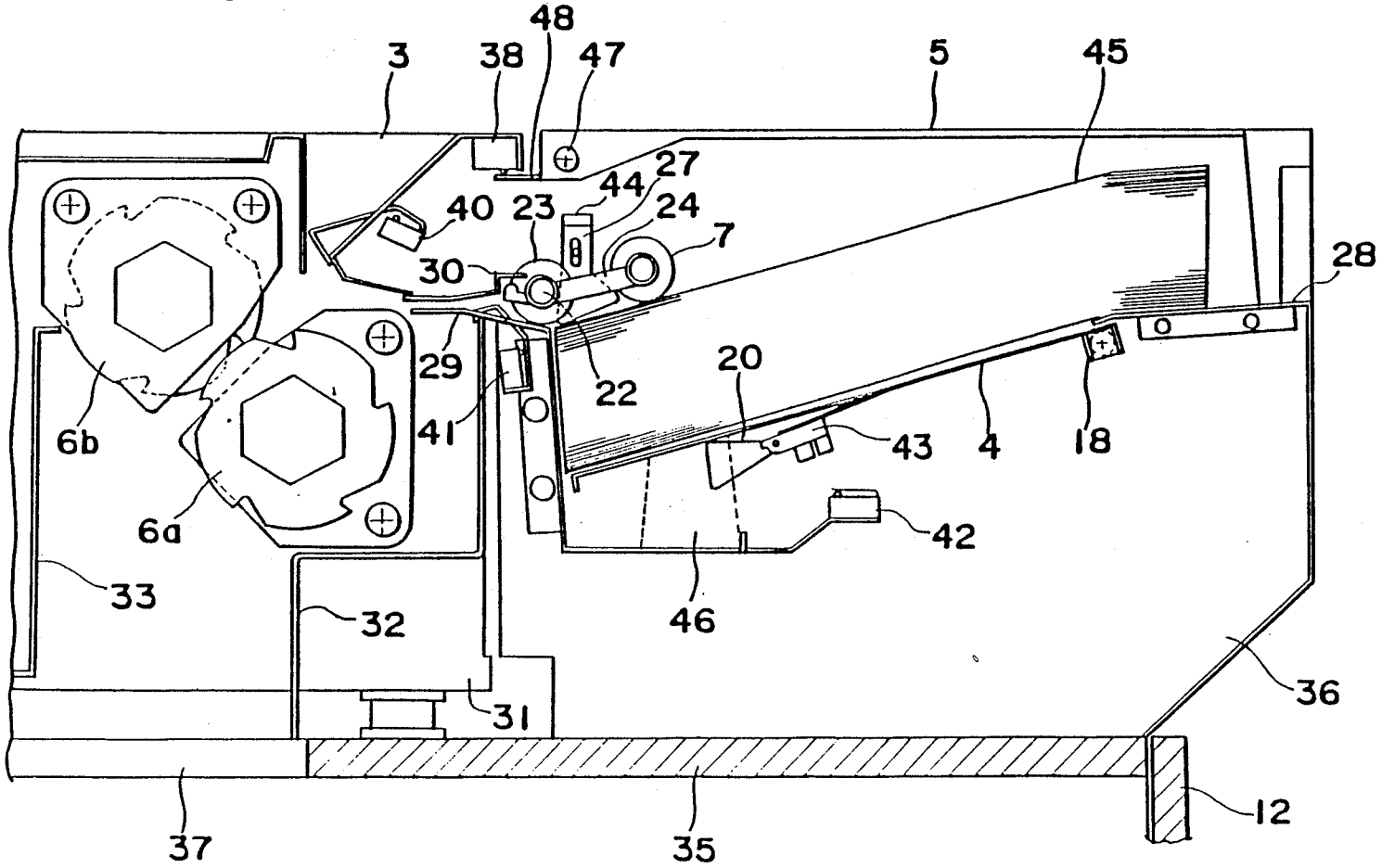

FIG. 6 illustrates the machine with the stack of a large number of, for example, about 300 to 500 sheets of papers 45 placed on the paper feed tray 4 and also with the paper feed tray 4 elevated. In this condition, the paper feed tray 4 is elevated, i.e., pivoted clockwise, as viewed in FIG. 6, about the pivot shaft 18 enough to permit the uppermost sheet of the stack of papers 45 to activate the actuator 27 with the sensor switch 44 consequently switched on. It is to be noted that a spring 46 is disposed between a carrier plate and the paper feed tray 4 for urging the paper feed tray 4 in a direction towards the elevated position, and this spring 46 is utilized only for the purpose of lessening a load which would be imposed on the first direct current drive motor 16.

Figure 7:
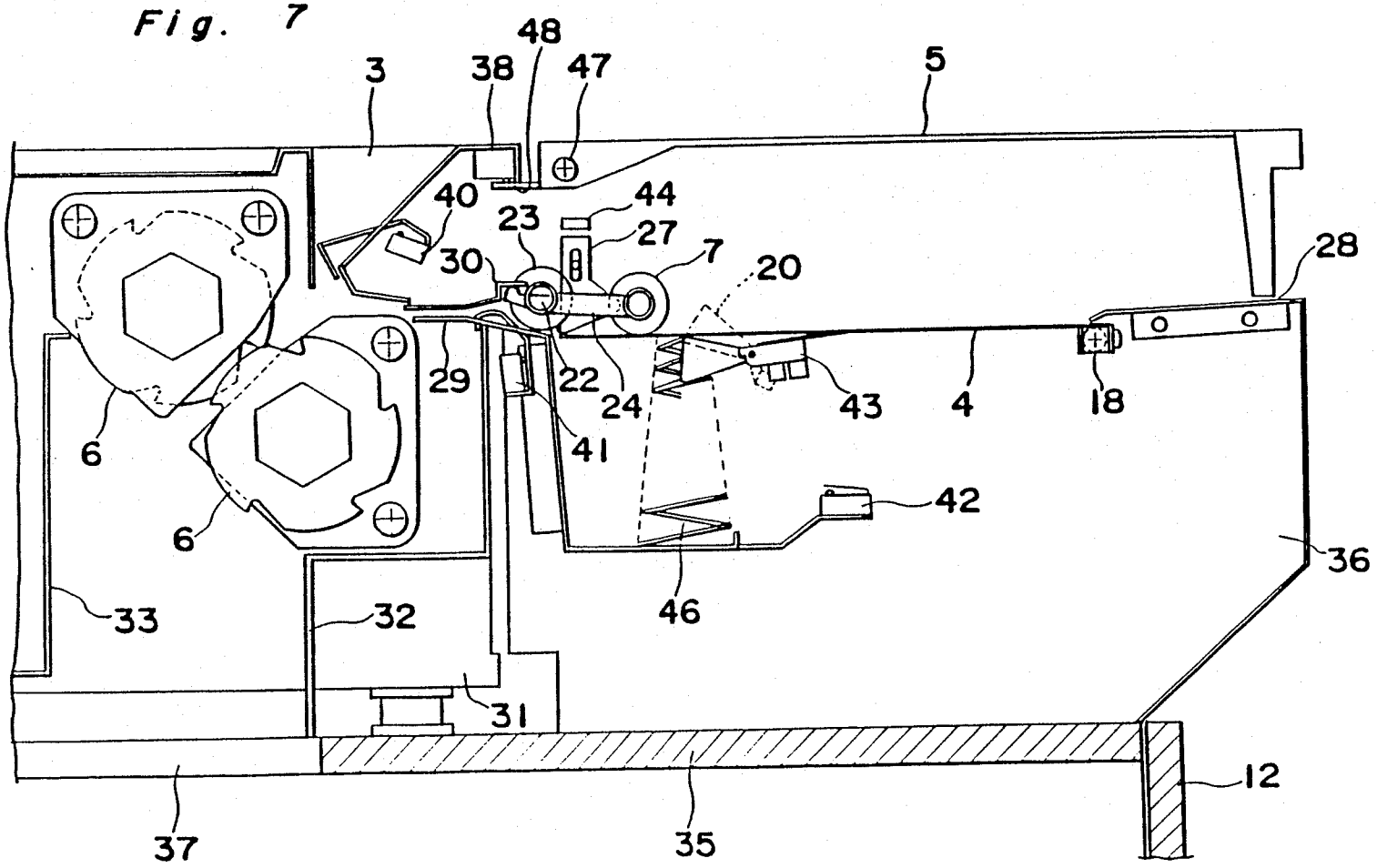

FIG. 7 illustrates the condition of the machine wherein only about a few sheets of paper are remaining on the paper feed tray 4. As can be readily understood from the comparison of the position of the paper feed rollers 7 shown in FIG. 6 and that shown in FIG. 7, the greater the number of papers of the stack placed on the paper feed tray 4, the higher the position of the paper feed rollers 7. In other words, the paper feed roller assembly comprised of the rollers 7 is so positioned and so supported as to pivot about the shaft 22 between a downwardly shifted position, as shown in FIG. 5, and an upwardly shifted position as shown in FIG. 6, the upwardly shifted position of the paper feed roller assembly being located a distance upwardly of the paper feed tray 4 which has been brought to the elevated position as shown in FIG. 7.

It has now become clear that the protective cover 5 is supported for pivotal movement between the closed position, as shown in FIGS. 6 and 7, and the opened position as shown in FIG. 5. A portion of the protective cover 5 on one side of its fulcrum 47, about which the protective cover 5 pivots, opposite to the space immediately above the paper feed tray 4 is integrally formed with a projection 48 for depressing the cover sensor switch (CSW) 38 so as to switch the latter on only when the protective cover 5 is pivoted to the closed position.

Figure 8:
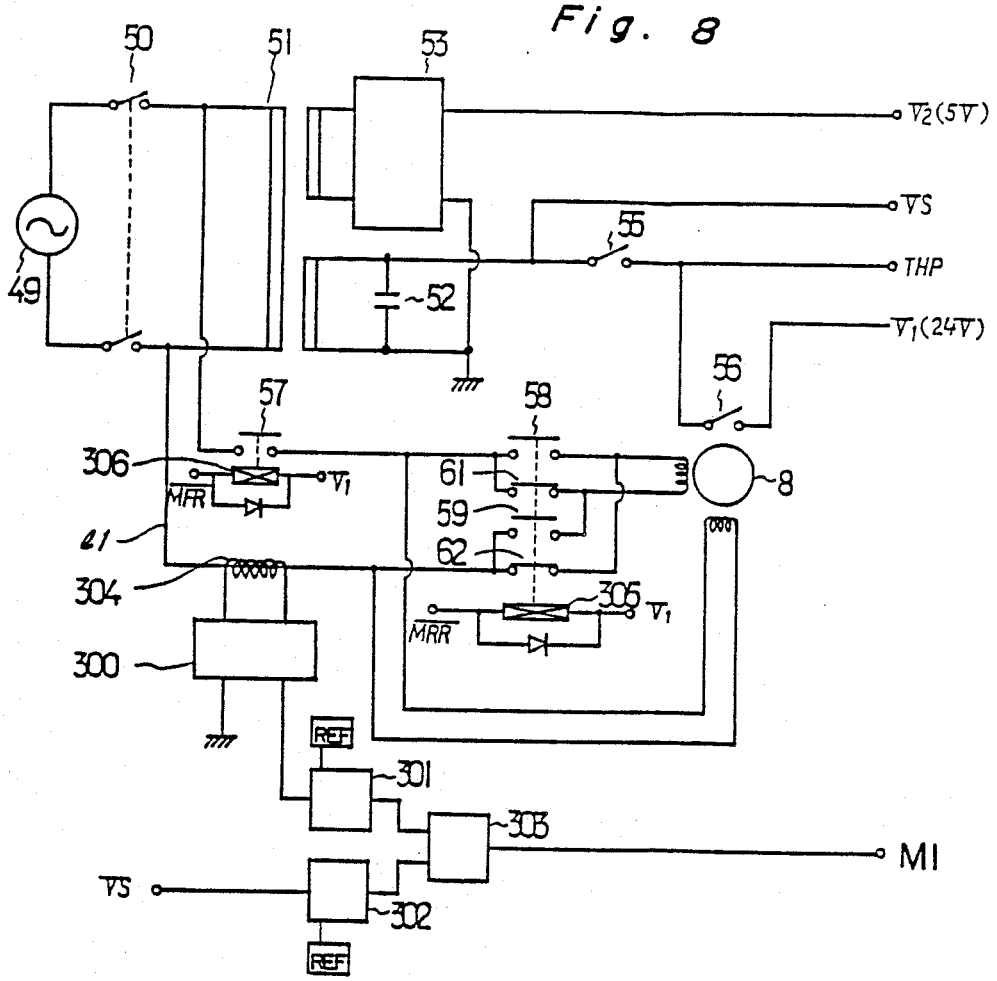
FIGS. 8 to 11, 13, 15*a* and 16 to 18 are circuit block diagrams showing electric control circuits used in the shredder.

FIG. 8 illustrates an electric control circuit used to control the operation of the cutter drive motor 8 for driving the cutting rollers 6a and 6b. In this figure, an AC power source 49 may be a commercial electric power outlet. A transformer 51 has a primary winding connected with the alternating current power source 49 through a main power switch 50. One secondary winding of the transformer 51 is connected with a stabilized source circuit 53 for converting the alternating current into a direct current. Another secondary winding of the transformer 51 is connected with a sensor switch 55 for detecting the opening of the access door 12 through a capacitor 52 for converting the alternating voltage transformed by the transformer 51 substantially into a direct current voltage. The sensor switch 55 is in turn connected in series with a safety sensor switch 56 used to detect an abnormal increase of the temperature of the cutter drive motor 8.

Reference characters $\overline{\text{MFR}}$ and $\overline{\text{MRR}}$ represent respective inverted versions of a drive signal MFR for driving the cutter drive motor 8 in a forward feed direction and a reverse-drive signal MRR for driving the cutter drive motor 8 in the opposite, reverse feed direction. Reference characters V2 and Vs indicate a stabilized voltage of 5V and a non-stabilized voltage of approximatey 24V, respectively.

Accordingly, when the inverted signal $\overline{MFR}$ is in low level state and the inverted signal $\overline{MRR}$ is in high level state, a relay coil 306 is charged with electricity to close a normally opened switch 57 so that the cutter drive motor 8 is driven in the forward feed direction. In contrast, when both the inverted signals $\overline{MFR}$ and $\overline{MRR}$ are in low level state, both of relay coils 305 and 306 are charged with electricity to close normally opened switches 57, 58 and 59 and to open normally closed switches 61 and 62 so that the cutter drive motor 8 can be driven in the reverse feed direction.

Furthermore, a coil 304 is wound around a power feed line l1 for feeding an electric power to the cutter drive motor 8 therethrough and is connected with a current-voltage converter 300 to detect the value of electric current flowing in the cutter drive motor 8. The current-voltage converter 300 outputs a voltage proportional to the current value and is connected with a comparator 301 in which the output of the current-voltage converter 300 is compared with a reference voltage. In the case where the output is greater than the reference voltage, the cutter drive motor 8 is judged to have been subjected to over-current or overload.

Reference character Vs indicates a non-stabilized voltage of approximately 24V and drops below approximately 18V in electric potential when the direct current drive motors 16 and 21 have been subjected to overload. This potential drop of Vs is detected in another comparator 302 in which Vs is compared with a reference voltage. Accordingly, when the direct current drive motors 16 and 21 have been overloaded, an output from the comparator 302 is rendered to be in high level state.

Both the outputs from the comparators 301 and 302 are inputted into a logic circuit 303 of an OR gate which outputs a signal MI. Accordingly, the signal MI is rendered to be in high level state when the cutter drive motor 8 and the direct current drive motors 16 and 21 have been overloaded.

TRAY POSITION CONTROL

The paper feed tray 4 is so controlled, by the first direct current drive motor 16, as to pivot from the elevated position towards the lowered position about the pivot shaft 18 when the protective cover 5 in the closed position is opened, when the stack of papers on the paper feed tray 4 has been completely fed out from the paper feed tray 4 or when no paper is placed on the paper feed tray 4, when the cutter drive motor 8 is driven in the reverse feed direction and when erroneous supply of the papers to be shredded has occurred. Also, when the stack of papers to be shredded is placed on the paper feed tray 4, the latter is pivoted about the pivot shaft 18 until the uppermost sheet of the stack of papers on the paper feed tray 4 actuates the actuator 27 to switch the sensor switch 44 on. During the shredding operation, since the papers placed on the paper feed tray 4 are fed sheets by sheets from the upper side thereof, the sensor switch 44 substantially periodically repeats on and off. When the sensor switch 44 has been turned off, the paper feed tray 4 is caused to move upwards until the sensor switch 44 is turned on.

CONTROL OF CUTTER DRIVE MOTOR 8

When either the switch 40 or 44 is turned on and for a predetermined time (approximately 1 to 6 seconds) subsequent to the switching off of one of the switches 40 and 44, the cutter drive motor 8 rotates in the forward feed direction to drive the cutting rollers **6*a* and 6*b* for the purpose of effecting the actual shredding operation. During the shredding, however, it a large number of papers or a hard substance of metal, wood or the like is fed to the cutting rollers 6*a* and 6*b*, the rotation of these rollers is brought to a halt. As a result, the cutter drive motor 8 is subjected to over-current, and upon detection of this fact, when the cutter drive motor 8 is brought to a halt, the lamp 209 flickers. Under such conditions, further insertion of the papers into the paper feed mouth 3 will not cause the cutting rollers 6*a* and 6*b* to resume the shredding operation. In order for the cutting rollers 6*a* and 6*b* to resume the shredding operation, the reverse key 201 (FIG. 3) has to be depressed to cause the cutter drive motor 8 i.e., the cutting rollers 6*a* and 6*b* to be reverse-driven in the opposite direction for the purpose of taking out the papers or the like clogging between the cutting rollers 6*a* and 6*b* before the cutting rollers 6*a* and 6*b*** are to be driven in the forward feed direction.

CONTROL OF PAPER FEED

Assuming that the stack of papers to be shredded is placed on the paper feed tray 4, the paper feed rollers 7 and the conveyor roller 23 are driven to draw a number of papers from the paper feed tray 4 towards the cutting rollers **6*a* and 6*b***. This paper feed operation will be halted in the following occasions.

(i) No paper pass through the duct defined between the lower and upper guide plates 29 and 30 even after a predetermined time has passed subsequent to the start of the paper feed.

(ii) Within a predetermined length of time subsequent to the passage of the paper through the duct defined between the guide plates 29 and 30, no next succeeding paper is drawn from the paper feed tray 4 so as to pass through the duct between the guide plates 29 and 30.

(iii) The paper feed tray 4 has been emptied.

(iv) During the shredding operation, the switch 44 is kept on more than a predetermined length of time (approximately 40 seconds) in spite of the fact that the paper feed rollers 7 are in motion.

SIMULTANEOUS SUPPLY FROM MOUTHS 2 AND 3

Papers drawn from the stack of papers on the paper feed tray 4 into the paper feed mouth 2 and papers inserted through the paper feed mouth 3 can be simultaneously shredded by the cutting rollers **6*a* and 6*b***.

Also, since the cutting rollers **6*a* and 6*b* are so designed as to be driven if the switch 40 is turned on even when the batch feed system fails to operate properly as a result of incorrect feed of the papers, the shredding operation with respect to the papers inserted through the paper feed mouth 3** can be effected.

CONTROL OF DIRECT CURRENT DRIVE MOTORS 16 AND 21

Figure 9:
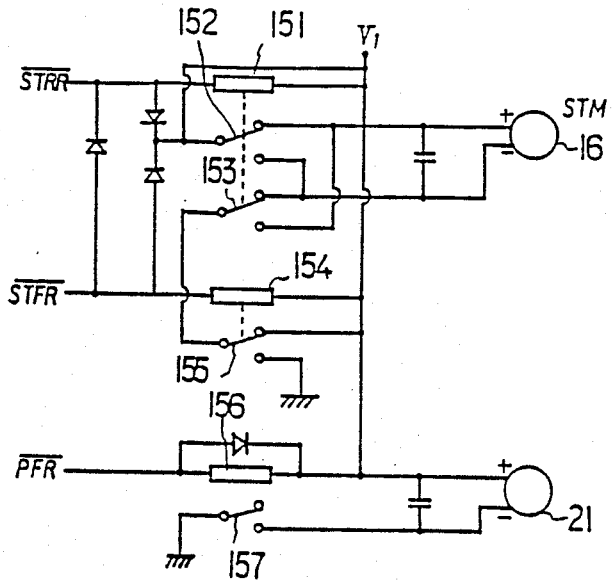

The first direct current drive motor 16 for moving the paper feed tray 4 up and down can rotate in both of opposite directions. FIG. 9 depicts a state in which both signals $\overline{STRR}$ and $\overline{STFR}$ are in high level state. In this event, since relay coils 151 and 154 are not charged with electricity, the first direct current drive motor 16 does not rotate. Change-over switches 152 and 155 are kept in a state as shown in FIG. 9.

On the other hand, when the signal $\overline{STFR}$ is in low level state, the relay coil 154 is charged with electricity. The switch 155 is then changed over so that the electric current is supplied to the first direct current drive motor 16 to rotate it in the forward feed direction. When the signal $\overline{STRR}$ is in low level state, the first direct current drive motor 16 rotates in the opposite, reverse feed direction. Moreover, when a signal $\overline{PFR}$ is in low level state, a relay coil 156 is charged with electricity and a change-over switch 157 is switched so that the second direct current drive motor 21 may rotate in the forward feed direction. The aforementioned signals $\overline{STRR}$, $\overline{STFR}$ and $\overline{PFR}$ are those outputted from a circuit as described hereinafter.

Referring now to FIGS. 10 to 18, control circuits necessitated to carry out the various controls described above will be explained.

Figure 11:
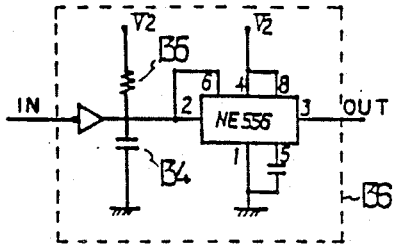
Figure 12:
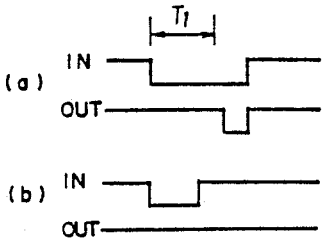
FIG. 12 is a time chart showing the relationships between inputs to and outputs from the circuit shown in FIG. 11.

FIG. 11 represents a timer circuit 136 and FIGS. 12(*a*) and 12(*b*) depict the relationships between inputs to and outputs from the timer circuit 136. As best shown in FIG. 12(*a*), when an input signal applied to the timer circuit 136 is in low level state for a length of time greater than a predetermined time T1, the timer circuit 136 generates a low level output signal during a period subsequent to the passage of the predetermined time T1 and before the input signal applied to the timer circuit 136 is again rendered to be in high level state. Similarly, as shown in FIG. 12(*b*), in the event that the input signal applied to the timer circuit 136 is in low level state below the predetermined time T1, the output signal from the timer circuit 136 remains unchanged and in high level state. The predetermined time T1 referred to above can be chosen as desired by selecting the resistance of a resistor 135 and the capacitance of a capacitor 134.

Figure 13:
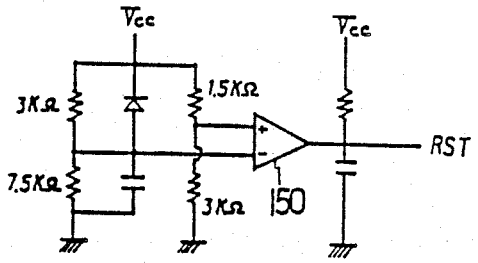
Figure 14:
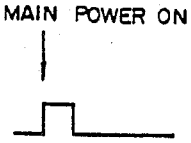
FIG. 14 is a time charge showing a signal outputted from the circuit shown in FIG. 13.

FIG. 13 depicts a reset signal outputting circuit for outputting a high level signal for a predetermined period after the main power switch 50 has been turned on. The output signal from this circuit is shown in FIG. 14.

Figure 10:
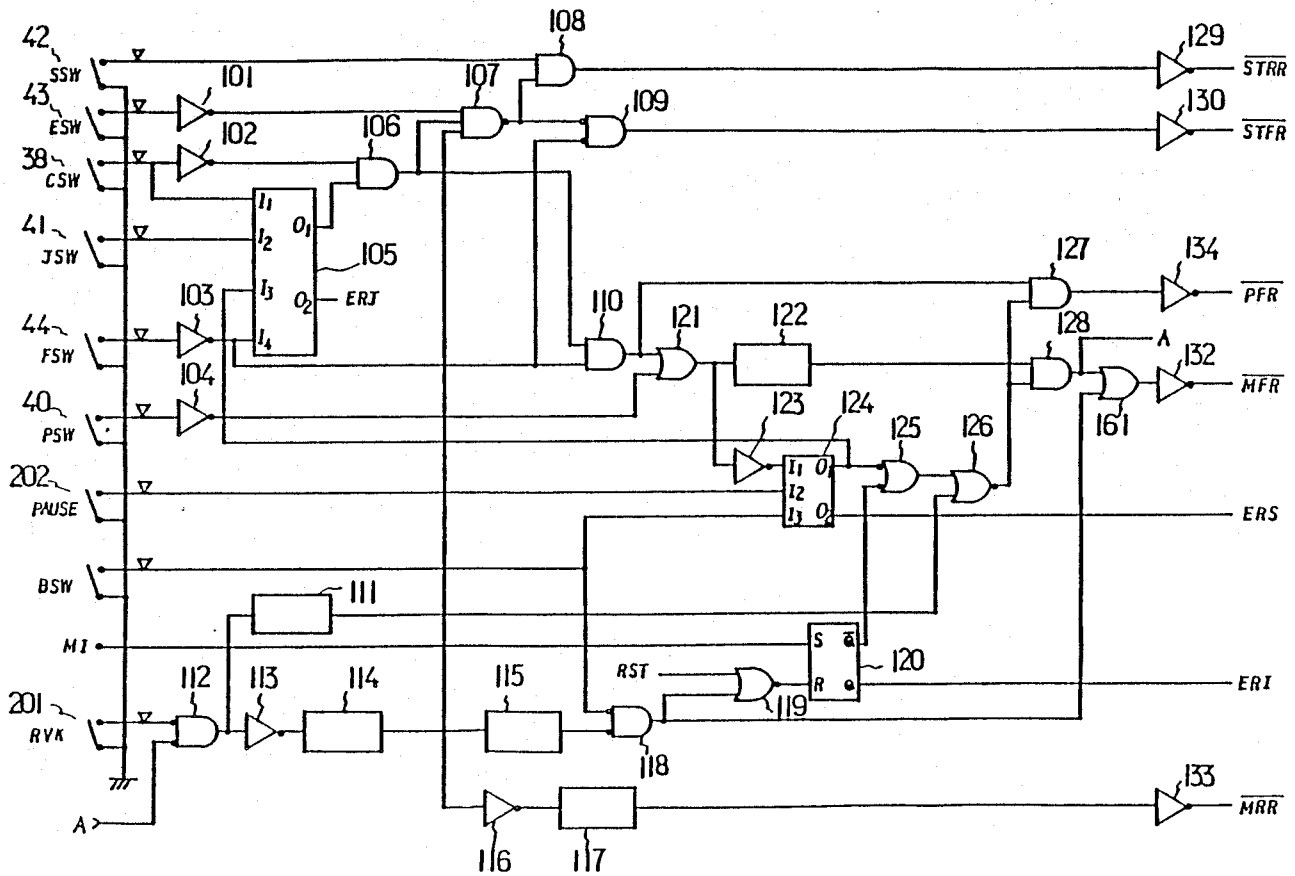

FIG. 10 illustrates a control circuit according to the present invention.

Figure 15A:
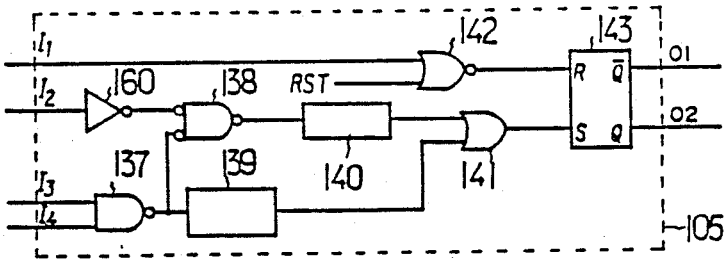

In FIG. 10, a circuit designated by 105 detects erroneous supply of the papers and outputs 01 and 02 with respect to inputs I1 to I4. When a certain paper feed trouble has been detected, the outputs 01 and 02 are rendered to be in low and high level state, respectively. A specific construction of the paper feed trouble detecting circuit 105 is shown in FIG. 15*a* wherein two timer circuits 139 and 140 as shown in FIG. 11 are provided. The predetermined length of time T1 for these timer circuits 139 and 140 are set to be 40 and 2.5 seconds, respectively.

This paper feed trouble detecting circuit 105 can detect two kinds of problems during the feed of papers. It is judged as one of the problems when no papers pass between the lower and upper guide plates 29 and 30 in spite of the fact that the predetermined length of time (2.5 seconds) has elapsed after the start of the feed operation. It is judged as another problem when the switch 44 is not turned off after the lapse of the predetermined length of time (40 seconds) during the shredding operation.

The former takes place, when the paper feed rollers 7 are out of order, or even if in order, when the switch 44 is not turned on by the clogging of papers.

When the normal shredding operation is repeatedly conducted, the paper 45 of the stack are fed sheets by sheets and the switch 44 repeats on and off. More specifically, when a first particular amount of paper 45 have been completely fed out from the paper feed tray 4 towards the cutting rollers 6*a* and 6*b*, the switch 44 is turned off so that the paper feed tray 4 is caused to move upwards. As a result, the switch 44 is turned on so that a second particular amount of papers are fed from the paper feed tray 4. Thus, the switch 44 is repeatedly turned on and off during the normal shredding operation.

In the case of the latter, even if the paper feed rollers 7 try to continue the feed operation in spite of the clogging of the papers between the guide plates 29 and 30, the switch 44 is activated, since the amount of the paper 45 never decreases.

Although the switch 44 normally repeats on and off as described above, it is continuously kept on during this kind of trouble. Accordingly, the detection of such a state is regarded as the paper feed trouble.

Figure 15B:
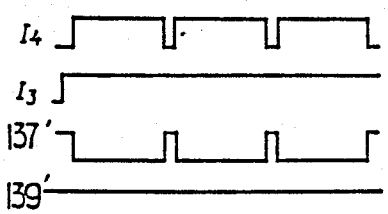
FIGS. 15*b* and 15*c* are time charts, in association with the circuit shown in FIG. 15*a*, indicative of the case where the papers to be shredded are normally fed and the case where a paper feed trouble has taken place, respectively.
Figure 15C:
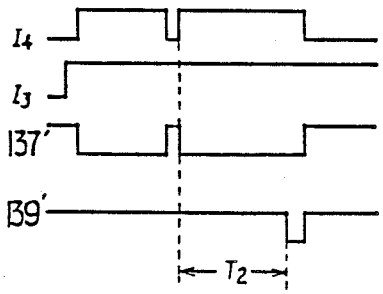

FIGS. 15*b* and 15*c* depict time charts in normal conditions and in abnormal conditions, respectively, during the feed of papers. In these time charts, 137' and 139' designate outputs from a NAND gate 137 and a timer 139, respectively. As shown in FIG. 15*b*, in the case where the switch 44 is repeatedly turned on and off within a predetermined length of time T2, the output 139' of the timer 139 is kept in a high level state. In contrast, as shown in FIG. 15*c*, when the switch 44 is kept on more than the predetermined length of time T2, the output 139' of the timer 139 is rendered to be in low level state so that an RS flip-flop 143 may be set.

Since a signal from the cover sensor switch (CSW) 38 and a reset signal are inputted into a reset terminal R of the RS flip-flop 143, this flip-flop 143 can be reset by opening the protective cover 5 of the paper feed tray 4, and thus, the paper feed trouble can be removed.

Accordingly, in case of a paper feed problem the outputs 01 and 02 of the paper feed trouble detecting circuit 105 are kept in low and high level state, respectively, until the protective cover 5 is opened or the main power switch 50 is once cut off and then turned on.

As shown in FIG. 10, the output 01 of the paper feed trouble detecting circuit 105 is inputted into an AND gate 106. Accordingly, when some trouble has taken place on the papers being fed during the shredding operation, an output of the AND gate 106 is rendered to be in low level state irrespective of whether the protective cover 5 is opened or closed and, outputs of an NAND gate 107 and an AND gate 108 are rendered to be in high level state while an output of an AND gate 109 is rendered to be in low level state. Consequently, the signals $\overline{STRR}$ and $\overline{STFR}$ are rendered to be in low and high level state respectively so that the first direct current drive motor 16 rotates in the reverse direction to move the paper feed tray 4 downwards.

When the switch (PSW) 40 or the switch (FSW) 44 is turned on, an output of an OR gate 121 is rendered to be in a high level state and inputted into a timer circuit 122 wherein the predetermined length of time T1 is set to be approximately 2.5 seconds, as in the timer circuit 136 shown in FIG. 11. This timer circuit 122 generates a signal $\overline{MFR}$ through an AND gate 128, an OR gate 161 and an inverter 132.

Accordingly, the signal $\overline{MFR}$ is kept in a low level state, when the switch (PSW) 40 or (FSW) 44 is kept on or for approximately 2.5 seconds after the switch (PSW) 40 or (FSW) 44 has been turned on. During this period, the cutter drive motor 8 rotates in the reverse direction. In the case where the switch (FSW) 44 is activated, a signal $\overline{PFR}$ is kept in low level state so that the second direct current drive motor 21 may rotate for enabling the paper feed rollers 7 to feed the papers.

The interruption of the shredding operation will be described hereinafter.

When a pause key 202 has been depressed during the shredding or when the container has become full of the shredded papers, not only the lamp 203 flickers but also the shredding operation is interrupted irrespective of the conditions of the switches (PSW) 40 and (FSW) 44.

Figure 16:
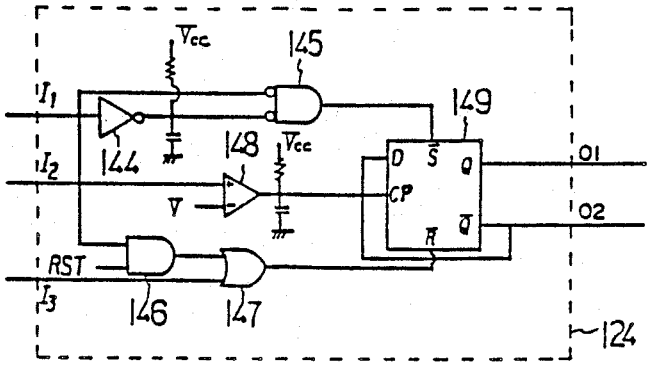

In FIG. 10, 124 designates an interruption control circuit which is illustrated in detail in FIG. 16.

In FIG. 16, when a leading edge of a pulse waveform is inputted into a terminal CP of a D-type edge triggered flip-flop 149, a signal being inputted into an input terminal D at this moment is outputted as an output Q. This output Q is kept as it is until another leading edge of the pulse waveform is inputted into the terminal CP again. However, when a low level signal has been inputted into a terminal $\overline{S}$ or into a terminal $\overline{R}$, the flip-flop 149 outputs a high level signal or a low level one as the output Q, respectively. Accordingly, when the pause key 202 is depressed one time during the shredding, the leading edge of the pulse waveform is inputted into the terminal CP of the flip-flop 149 so that the output Q is rendered to be in low level state. In this event, another output $\overline{Q}$ is rendered to be in high level state. In this state, when the pause key 202 is depressed again, the output Q is rendered to be in high level state. When the container has become full of the shredded papers during the shredding, a low level signal is inputted into the circuit 124 as an input I3. An AND gate 146 outputs a high level signal only when the main power switch 50 has been turned on or when the shredding operation is not being carried out. Accordingly, during the shredding, when the container has become full of pieces of the papers, a low level signal is inputted into the terminal $\overline{R}$ of the flip-flop 149 so that the output Q is rendered to be in low level state. In this way, when the pause key 202 has been depressed or when the container has become full of pieces of the papers, the flip-flop 149 outputs a low level signal as the output Q and the shredding operation is, therefore, interrupted, with the lamp 203 being caused to flicker. Under such conditions, when the pause key 202 is depressed again, the output Q is rendered to be in high level state. Alternatively, when the switches 40 (PSW) and 44 (FSW) are turned on again, an output from the AND gate 145 is rendered to be in high level state so that a high level signal is inputted into the terminal $\overline{S}$ of the flip-flop 149 and the output Q is rendered to be in high level state. Thus, when a high level signal is outputted as the output Q from the flip-flop 149, the shredding operation is resumed.

Subsequently, the case where the cutter drive motor 8 is caused to rotate in the reverse direction will be explained thereafter.

As described so far with reference to FIG. 8, when the cutter drive motor 8 or the direct current drive motor 16 or 21 has been overloaded, the signal MI is rendered to be in high level state. An RS flip-flop 120 is, therefore, set and sends high and low level signals as outputs Q and $\overline{Q}$, respectively. As a result, the signal $\overline{MFR}$ is rendered to be in high level state so that the shredding operation may be brought into a halt, with the lamp 206 being caused to flicker. In this event, when a trailing edge of the pulse waveform is inputted into a terminal R of the flip-flop 120, the outputs Q and $\overline{Q}$ are rendered to be in low and high level state, respectively, so that the shredding operation can be resumed at any time. The trailing edge of the pulse waveform can be inputted into the terminal R by depressing the reverse key 201. In FIG. 10, 111, 114, 115 and 117 designate the timer circuits as shown in FIG. 11. Accordingly, during the depression of the reverse key 201, the signals $\overline{MRR}$ and $\overline{MFR}$ are kept in low level state and the cutter drive motor 8 rotates in the reverse direction.

Figure 17:
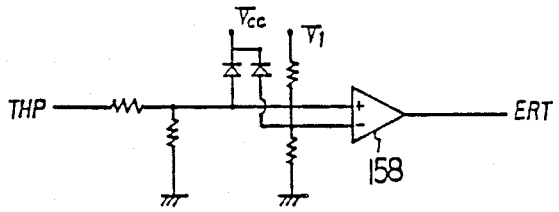

FIG. 17 depicts a circuit for detecting the temperature rise of the cutter drive motor 8. When the temperature of the cutter drive motor 8 has risen over a predetermined temperature, the switch 56 shown in FIG. 8 is opened so that an electric voltage V1 may become 0V. This voltage V1 can be detected by comparing it with a reference voltage in a comparator 158. Accordingly, when the temperature of the cutter drive motor 8 exceeds the predetermined one, the comparator 158 outputs a high level signal as a signal ERT.

Figure 18:
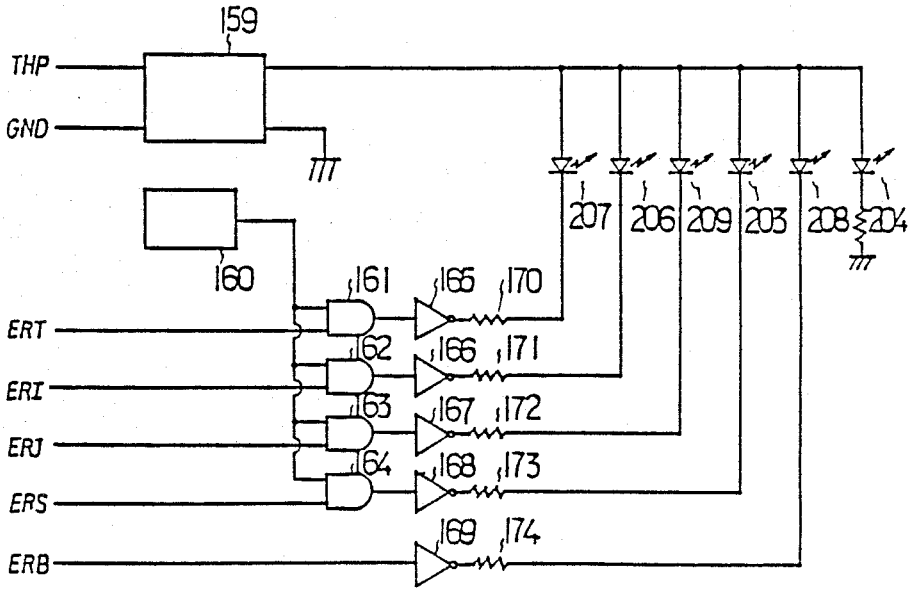

FIG. 18 illustrates a control circuit of a display portion.

An output THP shown in FIG. 8 is stabilized in a stabilized source circuit 159. Signals ERT, ERI, ERJ, ERS and ERB are rendered to be in high level state, respectively when the temperature of the cutter drive motor 8 has exceeded the predetermined one, when the cutter drive motor 8 and the direct current drive motors 16 and 21 have been overloaded, when a certain problem has occurred on the papers being fed, when the shredding operation has been interrupted and, when the container has become full of the shredded papers. In this event, the lamps 203, 206, 207 and 209 are so controlled as to flicker, since an output of a pulse waveform generating circuit 160 is inputted into AND gates 161, 162, 163, 164. However, the lamps 204 and 208 does not flicker but is lighted on.

The operation of the control circuits described hereinabove will now be described with particular reference to time charts shown in FIGS. 19 to 22.

Figure 19:
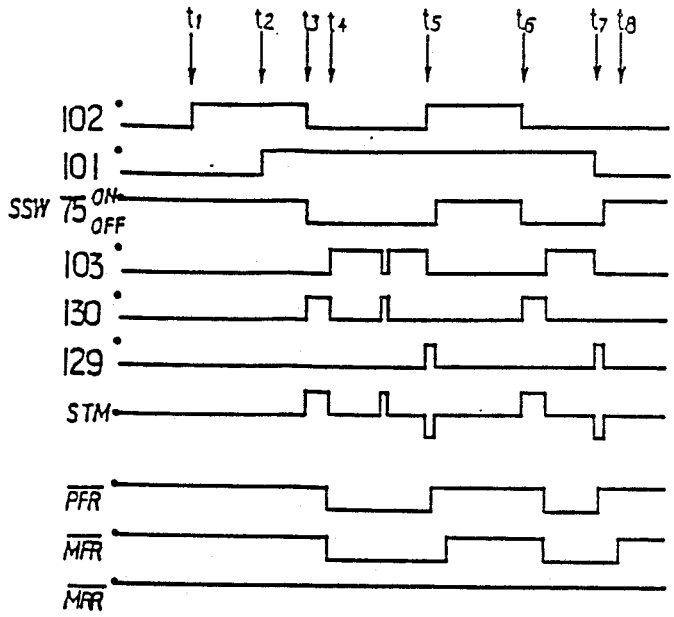
FIGS. 19 to 22 are time charts showing the timed relationship of several operating components used in the control circuits in the shredder.

It is, however, to be noted that reference characters t1 to t8 used in FIG. 19 represent the following time, respectively.

- t1: The protective cover 5 is opened with the switch 38 consequently turned off.
- t2: The stack of papers to be shredded is placed on the paper feed tray 4 with the switch 43 consequently turned on.
- t3: The protective cover 5 is closed with the switch 38 consequently turned on.
- t4: The shredding operation is initiated with the switch 44 turned on.
- t5: The protective cover 5 is opened during the shredding operation taking place, resulting in the switch 38 being turned off.
- t6: The protective cover 5 is closed after the stack of papers to be shredded has been supplemented, with the switch 38 turned on.
- t7: The paper feed tray 4 is emptied with all papers completely shredded, resulting the switch 43 being turned off.
- t8: The cutting rollers **6*a* and 6*b*** are brought to a halt after the passage of a predetermined time subsequent to the time t7, thereby completing the shredding operation.

When the protective cover 5 is opened at the time t1, the output from the inverter 102 is brought into a low level state. When the stack of the papers is placed on the paper feed tray 4 at the time t2, the switch 43 is turned on and the output from the inverter 101 is brought into a high level state.

When the protective cover 5 is closed at the time t3, the inverter 102 generates a high level signal which is in turn applied to the AND gate 107 from which a high level signal is generated. Since the inverter 103 generates a low level signal before the switch 44 is closed, that is, the output from the inverter 103 is brought into a high level state, the normally opened contact 155 is closed to cause the first direct current drive motor 16 to rotate in a positive direction so that the paper feed tray 4 can be pivoted about the pivot shaft 18 from the lowered position towards the elevated position.

At the subsequent time t4, the uppermost sheet of the stack of papers on the paper feed tray 4 actuates the actuator 27 to turn the switch 44 on, with the consequence that the inverter 103 generates a high level signal. At the same time, both of $\overline{PFR}$ and $\overline{MFR}$ are brought into a low level state with the consequence that both of the second direct current drive motor 21 and the cutter drive motor 8 are driven, thereby initiating the shredding operation with the papers on the paper feed tray 4 drawn into the paper feed mouth 2 and towards the cutting zone between the cutting rollers 6*a* and 6*b*.

When the protective cover 5 is opened at the time t5 during the shredding operation, the output signal from the AND gate 107 is rendered to be in low level state and the output from the inverter 129 is rendered to be in low level state until the switch 42 is turned on. Therefore, the change-over switches 153 and 154 are switched over in position to drive the first direct current drive motor 16 in a negative direction opposite to the positive direction, causing the paper feed tray 4 to pivot from the elevated position towards the lowered position.

When the protective cover 5 is closed at the time t6 after a number of papers to be shredded are added to the stack of paper already on the paper feed tray 4 and when the switch 38 is consequently turned on, the inverter 130 continues generating a low level signal until the switch 44 is turned on, with the consequence that the paper feed tray 4 is moved from the lowered position towards the elevated position, followed by the continued shredding operation. Should all of the papers on the paper feed tray 4 have been completely drawn into the paper feed mouth 2 and towards the cutting zone, the switch 43 is turned off and the output from the inverter 101 is rendered to be in low level state. After the subsequent passage of a predetermined time, for example, about 2.5 seconds, set in the timer 120, $\overline{MFR}$ is rendered to be in high level state causing the cutting rollers 6*a* and 6*b* to be brought into a halt.

Figure 20:
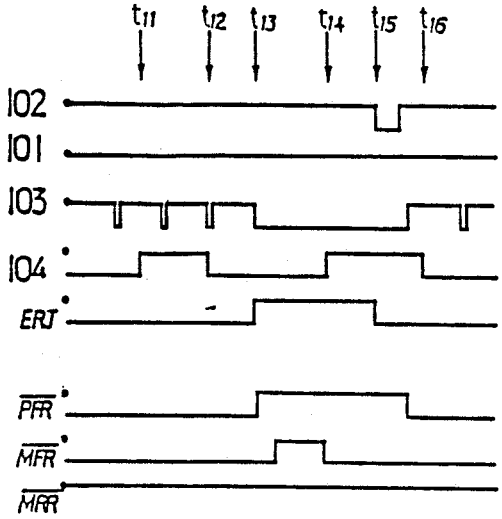

Reference characters t11 to t16 used in FIG. 20 represent the following time, respectively, which occur during the shredding operation taking place with the utilization of the single feed system.

t11: The shredding operation is initiated with papers inserted through the paper feed mouth 3.

t12: The shredding operation with the utilization of the single feed system has ended.

t13: Any trouble in the paper feed has occurred in the batch feed system.

t14: The shredding operation with the utilization of the single feed system is initiated again.

t15: The protective cover 5 is opened.

t16: The shredding operation resumed is completed.

When some papers are inserted into the paper feed mouth 3 at the time t11 during the execution of the shredding operation with the utilization of the batch feed system, the switch 40 is turned on and the output from the inverter 104 is rendered to be in high level state. The papers supplied by way of the batch feed system and the papers supplied by way of the single feed system join together in the cutting zone and are then shredded by the cutting rollers 6*a* and 6*b*. The shredding of the papers supplied by way of the single feed system terminates at the time t12.

In the event of occurrence of a paper feed problem at the time t13 in the batch feed system, both of ERJ and $\overline{PFR}$ are rendered to be in a high level state, with the consequence that the second direct current drive motor 21 is brought to a halt and the shredding operation of the papers supplied by way of the batch feed system is, therefore, interrupted.

When the papers are inserted into the paper feed mouth 2 at the time t14 during the occurrence of the paper feed trouble in the batch feed system, the output from the OR gate 121 is rendered to be in low level state regardless of the output of the AND gate 110 and, therefore, $\overline{MFR}$ is rendered to be in low level state, with the consequence that the cutter drive motor 8 is driven so that the papers inserted through the paper feed mouth 2 can be shredded at any time.

The opening of the protective cover 5 at the time t15 renders ERJ to be in low level state, thereby removing the paper feed trouble once occurring. When the protective cover 5 is closed after the removal of the paper feed problem, the shredding operation subject to the papers fed by way of the batch feed system (from the paper feed tray 4) can be resumed.

Figure 21:
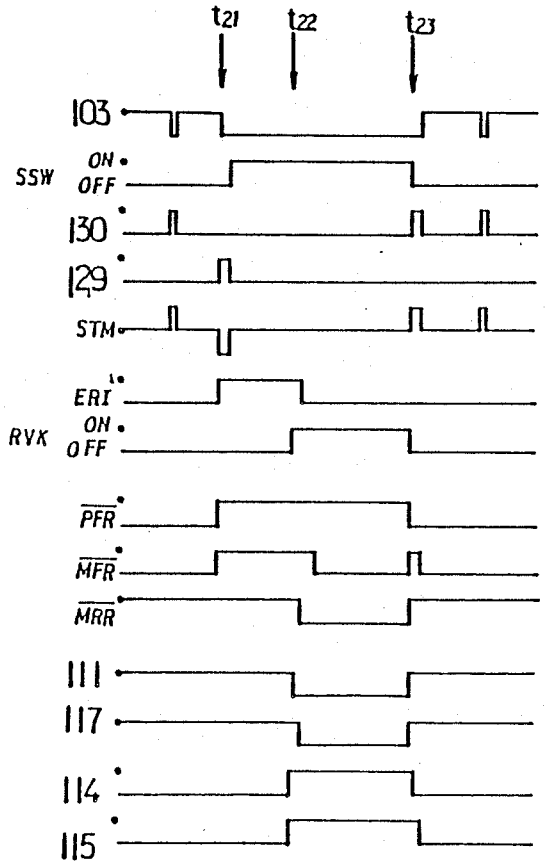

In FIG. 21, characters t21, t22 and t23 represent the time at which the cutter drive motor 8 is overloaded, the time at which the reverse key 201 is switched on, and the time at which the reverse key 201 is switched off, respectively.

In the event of the overloading of the cutter drive motor 8 at the time t21 during the execution of the shredding operation with the papers supplied by way of the batch feed system, the overload signal ERI is rendered to be in high level state and the shredding operation is brought into a halt.

When the reverse key 201 is depressed at the time t22, $\overline{MRR}$ is rendered to be in low level state and the cutting rollers 6*a* and 6*b*, therefore, rotate in the reverse direction. In this event, the overload signal ERI is reset into a low level state. In this way, the removal of the trouble resulting from the overloading of the cutter drive motor 8 can be effected by depressing the reverse key 201. The cutting rollers 6*a* and 6*b* rotate only when the reverse key 201 is being depressed.

Figure 22:
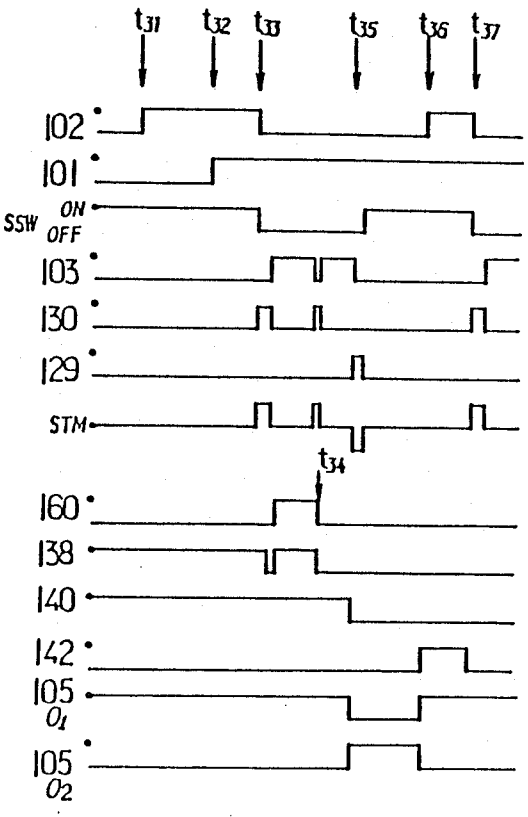

Time t31 to t37 shown in the chart of FIG. 22 associated with the detection of the occurrence of a trouble in the feed of papers to be shredded are descriptive of the following occurrences, respectively.

t31: The opening of the protective cover 5.

t32: The setting of the papers to be shredded.

t33: The closure of the protective cover 5.

t34: Detection of the leading end of the paper drawn towards the cutting zone.

t35: The passage of the predetermined time (about 2.5 seconds), set in the timer 140, subsequent to the time t34, with no leading end of the next succeeding paper detected. This is indicative of the occurrence of the paper feed trouble.

t36: The opening of the protective cover 5 to remove the paper feed trouble.

t37: The closure of the protective cover 5 to resume the shredding operation.

It is to be noted that the time t31 to t33 shown in the chart of FIG. 22 is identical with the time t1 to t3 shown in the chart of FIG. 19.

When the output from the inverter 160 is rendered to be in low level state at the time t34, it means that the passage of the trailing end of one of the papers past the position of the switch 41 has been detected by the switch 41. However, since the output from the inverter 160 can be rendered to be in high level state at the time t35 after a predetermined period subsequent to the time t34, the output from the timer 140 is rendered to be in low level state so that the RS flip-flop 143 may be set. Simultaneously therewith, the output from the inverter 129 is rendered to be in low level state and, therefore, the paper feed tray 4 can be moved towards the lowered position about the pivot shaft 18.

By the above described construction of the present invention, when a certain paper feed trouble has taken place with respect to the papers to be shredded, the shredding operation is immediately interrupted, thereby preventing a breakdown of the shredder.

Furthermore, since abnormal conditions of the direct current drive motors are detected on the basis of an electric voltage being supplied to each motor, not only the control for detecting such abnormal conditions can be simplified, but also the shredder can be readily kept in order.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A shredding machine which comprises:

a cutting means for shredding paper material;

a paper feed tray movable between lowered and elevated positions and adapted to support thereon the paper material to be shredded;

a feed means for feeding the paper material from said paper feed tray towards said cutting means;

a paper material detecting means for detecting a topmost portion of the paper material placed on said paper feed tray;

a paper feed tray driving means for moving said paper feed tray in response to a signal outputted from said paper material detecting means; and a control means for interrupting the operation of said feed means in the case where the signal outputted from said paper material detecting means remains unchanged over a predetermined length of time.

2. The machine as claimed in claim 1, wherein said paper material detecting means is provided in the vicinity of said feed means.

3. A shredding machine which comprises:

a cutting means for shredding paper material;

a paper feed tray movable between lowered and elevated positions and adapted to support thereon the paper material to be shredded;

a feed means for feeding the paper material from said paper feed tray towards said cutting means;

a first driving means for moving the paper material placed on said paper feed tray towards said feed means;

a second driving means for driving said feed means;

a comparing means for comparing an electric voltage supplied to said first and second driving means with a predetermined voltage; and a control means for controlling at least one of said first and second driving means in response to a signal outputted from said comparing means.

* * * * *